US007582577B2

(12) United States Patent
Vinson

(10) Patent No.: US 7,582,577 B2
(45) Date of Patent: Sep. 1, 2009

(54) FIBROUS STRUCTURE COMPRISING AN OIL SYSTEM

(75) Inventor: Kenneth Douglas Vinson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 763 days.

(21) Appl. No.: 11/387,301

(22) Filed: Mar. 23, 2006

(65) Prior Publication Data

US 2007/0049142 A1 Mar. 1, 2007

Related U.S. Application Data

(60) Provisional application No. 60/711,736, filed on Aug. 26, 2005, provisional application No. 60/772,107, filed on Feb. 10, 2006.

(51) Int. Cl.
*B32B 27/04* (2006.01)

(52) U.S. Cl. ..... 442/100; 442/97; 442/99

(58) Field of Classification Search ..... None
See application file for complete search history.

(56) References Cited

U.S. PATENT DOCUMENTS

| | | | |
|---|---|---|---|
| 2,826,551 | A | 3/1958 | Green |
| 3,301,746 | A | 1/1967 | Sanford et al. |
| 3,473,576 | A | 10/1969 | Amneus |
| 3,573,164 | A | 3/1971 | Friedberg et al. |
| 3,821,068 | A | 6/1974 | Shaw |
| 3,825,381 | A | 7/1974 | Dunning et al. |
| 3,949,035 | A | 4/1976 | Dunning et al. |
| 3,964,500 | A | 6/1976 | Drakoff |
| 3,974,025 | A | 8/1976 | Ayers |
| 3,994,771 | A | 11/1976 | Morgan, Jr. et al. |
| 4,100,324 | A | 7/1978 | Anderson et al. |
| 4,166,011 | A | 8/1979 | Lugstenmann et al. |
| 4,191,609 | A | 3/1980 | Trokhan |
| 4,239,065 | A | 12/1980 | Trokhan |
| 4,300,981 | A | 11/1981 | Carstens |
| 4,364,837 | A | 12/1982 | Pader |
| 4,528,239 | A | 7/1985 | Trokhan |
| 4,613,447 | A | 9/1986 | Hara et al. |
| 4,637,859 | A | 1/1987 | Trokhan |
| 5,059,282 | A | 10/1991 | Ampulski et al. |
| 5,215,626 | A | 6/1993 | Ampulski et al. |
| 5,246,545 | A | 9/1993 | Ampulski et al. |
| 5,354,425 | A | 10/1994 | Mackey et al. |
| 5,449,551 | A | 9/1995 | Tamiguchi |
| 5,525,345 | A | 6/1996 | Warner et al. |
| 5,529,665 | A | 6/1996 | Kaun |
| 5,552,020 | A | 9/1996 | Smith et al. |
| 6,241,850 | B1 | 6/2001 | Kelly |
| 6,547,928 | B2 | 4/2003 | Barnholtz et al. |
| 6,607,637 | B1 | 8/2003 | Vinson et al. |
| 6,755,939 | B2 | 6/2004 | Vinson et al. |
| 6,797,117 | B1 | 9/2004 | McKay et al. |
| 6,855,229 | B2 | 2/2005 | McKay et al. |
| 2003/0013627 | A1 | 1/2003 | Bermejo et al. |
| 2004/0188047 | A1 | 9/2004 | Nakamura et al. |
| 2004/0255396 | A1 | 12/2004 | Vinson et al. |
| 2005/0136097 | A1 | 6/2005 | Hsu |

FOREIGN PATENT DOCUMENTS

| | | |
|---|---|---|
| EP | 0613979 A1 | 9/1994 |
| GB | 849433 | 9/1960 |
| WO | WO 97/30217 | 8/1997 |
| WO | WO 00/04230 | 1/2000 |
| WO | WO 03/005981 | 1/2003 |

OTHER PUBLICATIONS

Geffroy, et al., "Molar Mass Selectivity in the Adsorption of Polyacrylates on Calcite", *Colloids and Surfaces, A: Physicochemical and Engineering Aspects*, vol. 162, pp. 107- 121 (2000).

*Primary Examiner*—Arti Singh-Pandey
(74) *Attorney, Agent, or Firm*—C. Brant Cook

(57) ABSTRACT

Fibrous structures comprising an oil system, sanitary tissue products comprising such fibrous structures and processes for making such fibrous structures and/or sanitary tissue products are provided. More particularly, fibrous structures comprising an oil system comprising a non-silicone oil comprising a triglyceride having a fatty acid profile containing a palmitic acid content of greater than about 15 wt %, sanitary tissue products comprising such fibrous structures and processes for making such fibrous structures are provided.

22 Claims, No Drawings

FIBROUS STRUCTURE COMPRISING AN OIL SYSTEM

CROSS REFERENCE TO RELATED APPLICATIONS

The present application claims the benefit of U.S. Provisional Application No. 60/711,736 filed Aug. 26, 2005 and claims the benefit of U.S. Provisional Application No. 60/772,107 filed Feb. 10, 2006.

FIELD OF THE INVENTION

The present invention relates to fibrous structures comprising an oil system, sanitary tissue products comprising such fibrous structures and processes for making such fibrous structures and/or sanitary tissue products. More particularly, the present invention relates to fibrous structures comprising an oil system comprising a non-silicone oil comprising a triglyceride having a fatty acid profile containing a palmitic acid content of greater than about 15 wt %, sanitary tissue products comprising such fibrous structures and processes for making such fibrous structures.

BACKGROUND OF THE INVENTION

Fibrous structures, such as sanitary tissue products, have utilized oils, especially silicone oils, in the past to provide surface softening. However, consumers of fibrous structures continue to desire even more softness that is not deliverable solely by surface softening techniques and/or silicone oils. In other words, there is still an existing need for fibrous structures that exhibit even more softness than what can be delivered by surface softening techniques and/or silicone oils.

SUMMARY OF THE INVENTION

The present invention fulfills the need described above by providing a fibrous structure comprising an oil system comprising a non-silicone oil, sanitary tissue products comprising such fibrous structures and processes for making such fibrous structures and/or sanitary tissue products.

In one example of the present invention, a fibrous structure comprising an oil system comprising a non-silicone oil comprising triglyceride having a fatty acid profile containing a palmitic acid content of greater than about 15 wt %, is provided.

In another example of the present invention, a fibrous structure comprising a non-silicone oil comprising a triglyceride having a fatty acid profile containing a palmitic acid content of greater than about 15 wt % and a silicone oil, wherein a surface of the fibrous structure comprise a greater weight percent of the silicone oil than the non-silicone oil, is provided.

In yet another example of the present invention, a single- or multi-ply sanitary tissue product comprising a fibrous structure in accordance with the present invention, is provided.

In still another example of the present invention, a process for making a fibrous structure, the process comprising the step of contacting a fibrous structure with an oil system comprising a non-silicone oil comprising a triglyceride having a fatty acid profile containing a palmitic acid content of greater than about 15 wt %, is provided.

Accordingly, the present invention provides fibrous structure comprising an oil system, sanitary tissue products comprising such fibrous structures and processes for making such fibrous structures and/or sanitary tissue products.

DETAILED DESCRIPTION OF THE INVENTION

"Fiber" as used herein means an elongate particulate having an apparent length greatly exceeding its apparent width, i.e. a length to diameter ratio of at least about 10. More specifically, as used herein, "fiber" refers to papermaking fibers. The present invention contemplates the use of a variety of papermaking fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, and bagasse can be used in this invention. Synthetic fibers, such as polymeric fibers, can also be used. Elastomeric polymers, polypropylene, polyethylene, polyester, polyolefin, and nylon, can be used. The polymeric fibers can be produced by spunbond processes, meltblown processes, and other suitable methods known in the art.

An embryonic fibrous web can be typically prepared from an aqueous dispersion of papermaking fibers, though dispersions in liquids other than water can be used. The fibers are dispersed in the carrier liquid to have a consistency of from about 0.1 to about 0.3 percent. It is believed that the present invention can also be applicable to moist forming operations where the fibers are dispersed in a carrier liquid to have a consistency of less than about 50% and/or less than about 10%.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels).

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a paper product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or paper product comprising the fibrous structure.

"Total Dry Tensile Strength" or "TDT" of a fibrous structure of the present invention and/or a paper product comprising such fibrous structure is measured as follows. One (1) inch by five (5) inch (2.5 cm×12.7 cm) strips of fibrous structure and/or paper product comprising such fibrous structure are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The TDT is the arithmetic total of MD and CD tensile strengths of the strips.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$. The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Apparent Density" or "Density" as used herein means the basis weight of a sample divided by the caliper with appropriate conversions incorporated therein. Apparent density used herein has the units $g/cm^3$.

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

"Layered" as used herein means that a fibrous structure comprises two or more layers of different fiber compositions (long, short, hardwood, softwood, curled/kinked, linear). Layered fibrous structures are well known in the art as exemplified in U.S. Pat. Nos. 3,994,771, 4,300,981 and 4,166,001 and European Patent Publication No. 613 979 A1. Fibers typically being relatively long softwood and relatively short hardwood fibers are used in multi-layered fibrous structure papermaking processes. Multi-layered fibrous structures of the present invention may comprise at least two superposed layers, an inner layer and at least one outer layer contiguous with the inner layer. In one example, a multi-layered fibrous structures of the present invention may comprise three superposed layers, an inner or center layer, and two outer layers, with the inner layer located between the two outer layers. In one example, the two outer layers may comprise a primary filamentary constituent of about 60% or more by weight of relatively short papermaking fibers having an average fiber length, L, of less than about 1.5 mm. These short papermaking fibers are typically hardwood fibers, such as hardwood Kraft fibers, especially Acacia pulp fibers alone or in combination with other hardwood pulp fibers such as Eucalyptus pulp fibers. In one example, the inner layer may comprise a primary filamentary constituent of about 60% or more by weight of relatively long papermaking fibers having an average fiber length, L, of greater than or equal to about 1.5 mm. These long papermaking fibers are typically softwood fibers, such as northern softwood Kraft fibers.

The fiber compositions forming the layers of the fibrous structure may comprise any mixture of fiber types.

The fibrous structures of the present invention may comprise at least two and/or at least three and/or at least four and/or at least five layers.

"Oil" as used herein means natural animal, vegetable, mineral, silicone oils and other substances, especially liquids, that exhibit similar characteristics as one or more of such oils (i.e., liquid under use conditions (for example, in one case, temperatures from about 23 to 40° C.) and possessing a lubricating property). Aqueous-based materials, especially those materials that comprise a continuous phase comprising water or some other polar solvent, which have oil-like characteristics for the purposes of this invention are excluded from the definition of "oil" herein.

Natural animal and vegetable oils include, but are not limited to, fats if they are present in a liquefied state under use conditions. Such fats and oils are triglycerides, i.e., they are glycerol fatty esters. In one example, the predominant range of fatty acid chains commonly varies from $C_8$ to $C_{22}$ and/or from $C_{12}$ to $C_{20}$ and/or from $C_{16}$ to $C_{18}$. The fatty acid chains can be saturated or unsaturated. Carbon-carbon double bonds defining such unsaturation within the fatty acid chains can be cis or trans in configuration.

In one example, the fatty acid chains will either be unsaturated, particularly cis conformation unsaturated, and/or shorter in chain length (for example $C_{12}$ or less), both of which tend to liquefy the oil. Unsaturated trans fats, saturated fats and long chain length fats may be solids at use temperature and not suitable as the oil for the present invention (but may be present as part of the oil "system" as defined herein). In one example, a particularly suitable oil for the present invention is palm oil, more specifically, the liquid fraction of palm oil commonly referred to as palm olein. Other nonlimiting examples of suitable natural oils at each end of the spectrum are soybean oil which is a longer chain length oil having a high level of unsaturation and MCT oil derived from coconut or palm kernel, which is a short chain length but fully saturated oil. Similarly some animal oils are also suitable. However, many animal oils contain too much high molecular weight and/or saturated fat, which might render them unsuitable as the oil of the present invention. Marine oils are most suitable since they are either absent or can be more easily purified of solid fats, solid monoesters, etc.

Mineral oils are suitable as the oil of the present invention. Mineral oil is typically taken as a fraction of crude oil. A example suitable mineral oil is distributed by Chevron Corporation of San Ramon, Calif. under the tradename "Paralux", such as Paralux 1001 and/or Paralux 6001.

Synthetic oils are also suitable. Synthetic mineral oils include those made from synthetic crude oil, i.e. upgraded bitumen. Synthetic oils created by the polymerization of methane by the Fischer-Tropsch process are also suitable.

Synthetic oils made by esterification of alcohols with fatty acids are also suitable or similar processes are included. For example, a methyl ester of fatty acids derived from soybean oil is suitable. The process used to create this oil is to saponify the triglyercide, i.e. soybean oil, with caustic soda in the presence of methanol. This yields glycerine and the methyl esters of the fatty acids, which can be readily separated. The methyl esters thus produce include a blend of methyl stearate, methyl linoleate, methyl linoleneate, and methyl palmitate and minor fractions of others. Similarly, fatty esters of carbohydrates are also acceptable as oils of the present invention provided they meet the requirements of fluidity and the essentially complete replacement of the alcohol groups with ester functionalities.

Silicone oils may also be used as a portion of the oil component of the present invention provided their content is limited to about 10% of the oil system. Silicone oils are typically polydimethylsiloxane based materials but may contain other functional groups within or appended to the silicone backbone.

The oil of the present invention may comprise any of the before mentioned oils and in one example, comprises a triglyceride with a specific fatty acid profile. Namely, it may have a fatty acid profile containing a palmitic acid content of greater than about 15 wt % of the triglyceride. In another example, an oil of the present invention has a triglyceride having a fatty acid profile containing a myristic acid content of from greater than about 0.5 to about 15 wt % and/or from about 1 to about 10 wt % and/or from about 1 to about 5 wt % of the oil. In one example, an oil of the present invention, especially a vegetable oil, more especially a palm oil, even more especially a liquid fraction of palm oil; namely, palm olein, comprises a triglyceride that exhibits a cis/trans ratio of greater than about 8 In yet another example, an oil of the present invention comprises a triglyceride having a fatty acid profile containing a linolenic acid content of less than about 2 wt % to 0%. In still another example, an oil of the present invention comprises at least about 50% and/or at least about 75% and/or at least about 90% to about 100% of a triglyceride, especially a triglyceride that exhibits a cis/trans ratio of greater than about 8.

"Oil system" as used herein means a composition comprising one or more oils. In one example, an oil system of the present invention comprises at least about 80% and/or at least about 85% and/or at least about 90% and/or at least about 95% of an oil.

"Non-silicone oil" as used herein means an oil that lacks a silicon moiety.

"Silicone oil" as used herein means an oil that comprises one or more silicon moieties.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

The fibrous structure of the present invention comprises an oil system

The fibrous structure of the present invention may additionally comprise any suitable ingredients known in the art. Nonlimiting examples of suitable ingredients that may be included in the fibrous structures include permanent and/or temporary wet strength resins, dry strength resins, softening agents, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers, opacifying agents and mixtures thereof. Such ingredients, when present in the fibrous structure of the present invention, may be present at any level based on the dry weight of the fibrous structure. Typically, such ingredients, when present, may be present at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structure of the present invention may be of any type, including but not limited to, conventionally felt-pressed fibrous structures; pattern densified fibrous structures; and high-bulk, uncompacted fibrous structures. The fibrous structures may be creped or uncreped and/or through-dried or conventionally dried. The sanitary tissue products made therefrom may be of a single-ply or multi-ply construction.

In one embodiment, the fibrous structure of the present invention is a pattern densified fibrous structure characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified fibrous structures are well known in the art as exemplified in U.S. Pat. Nos. 3,301,746, 3,974,025, 4,191,609 and 4,637,859.

In general, pattern densified fibrous structures are preferably prepared by depositing a papermaking furnish on a foraminous forming wire such as a Fourdrinier wire to form a wet fibrous structure and then juxtaposing the fibrous structure against a three-dimensional substrate comprising an array of supports. The fibrous structure is pressed against the three-dimensional substrate, thereby resulting in densified zones in the fibrous structure at the locations geographically corresponding to the points of contact between the array of supports and the wet fibrous structure. The remainder of the fibrous structure not compressed during this operation is referred to as the high-bulk field. This high-bulk field can be further dedensified by application of fluid pressure, such as with a vacuum type device or a blow-through dryer, or by mechanically pressing the fibrous structure against the array of supports of the three-dimensional substrate. The fibrous structure is dewatered, and optionally predried, in such a manner so as to substantially avoid compression of the high-bulk field. This is preferably accomplished by fluid pressure, such as with a vacuum type device or blow-through dryer, or alternately by mechanically pressing the fibrous structure against an array of supports of the three-dimensional substrate wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the fibrous structure is dried to completion, preferably still avoiding mechanical pressing. Preferably, from about 8% to about 65% of the fibrous structure surface comprises densified knuckles, the knuckles preferably having a relative density of at least 125% of the density of the high-bulk field.

The three-dimensional substrate comprising an array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are well known in the art as exemplified in U.S. Pat. Nos. 3,301,746, 3,821,068, 3,974,025, 3,573,164, 3,473,576, 4,239,065 and 4,528,239.

In one embodiment, the papermaking furnish is first formed into a wet fibrous structure on a foraminous forming carrier, such as a Fourdrinier wire. The fibrous structure is dewatered and transferred to a three-dimensional substrate (also referred to generally as an "imprinting fabric"). The furnish may alternately be initially deposited on a three-dimensional foraminous supporting carrier. Once formed, the wet fibrous structure is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the fibrous structure as discussed above, prior to drying the fibrous structure to completion. One method for accomplishing this is through application of mechanical pressure. This can be done, for example, by pressing a nip roll which supports the imprinting fabric against the face of a drying drum, such as a Yankee dryer, wherein the fibrous structure is disposed between the nip roll and drying drum. Also, preferably, the fibrous structure is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Typically, it is this drying/imprinting fabric which induces the structure to have differential density, although other methods of patterned densifying are possible and included within the scope of the invention. Differential density structures may comprise a field of low density with discrete high density areas distributed within the field. They may alternately or further comprise a field of high density with discrete low density areas distributed within that field. It is also possible for a differential density pattern to be strictly composed of discrete elements or regions , i.e. elements or regions which are not continuous. Continuous elements or regions are defined as those which extend to terminate at all edges of the periphery of the repeating unit (or useable unit in the event that the pattern does not repeat within such useable unit).

Most commonly, differential density structures comprise two distinct densities; however, three or more densities are possible and included within the scope of this invention. For purposes of this invention, a region is referred to as a "low density region" if it possesses a density less than the mean density of the entire structure. Likewise, a region is referred to as a "high density region" if it possesses a density greater than the mean density of the entire structure.

The fibrous structures of the present invention and/or sanitary tissue products comprising such fibrous structures may have a basis weight of between about 10 $g/m^2$ to about 120 $g/m^2$ and/or from about 14 $g/m^2$ to about 80 $g/m^2$ and/or from about 20 $g/m^2$ to about 60 $g/m^2$.

The fibrous structures of the present invention and/or sanitary tissue products comprising such fibrous structures may have a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structures of the present invention and/or sanitary tissue products comprising such fibrous structures may have a density of about 0.60 g/cc or less and/or about 0.30 g/cc or less and/or from about 0.04 g/cc to about 0.20 g/cc.

The fibrous structures of the present invention may natural fibers, non-naturally occurring fibers, such as spun cellulose fibers, and/or synthetic fibers.

Oil System

The oil system of the present invention comprise one or more oils. In one example, the oil system comprises a non-silicone oil. In another example, the oil system comprises a non-silicone oil and a silicone oil. In yet another example, the oil system consists of non-silicone oil(s). In still another example, the oil system comprises greater than 90% by volume of a non-silicone oil and less than 10% by volume of a silicone oil. In yet another example, the oil system comprises from greater than 90% to about 100% by volume of a non-silicone oil and from 0 to less than 10% by volume of a silicone oil. In even another example, the oil system comprises from about 95% to about 100% by volume of a non-silicone oil and from 0 to about 5% by volume of a silicone oil.

In one example, when the oil system comprises a non-silicone oil and a silicone oil, the oil system exists as a homogeneous or substantially homogeneous mixture of the non-silicone oil and silicone oil. In other words, the oil system does not exhibit phase separation of the non-silicone oil and the silicone oil after five minutes of forming the homogeneous or substantially homogeneous mixture and/or after 24 hours of the homogeneous or substantially homogeneous mixture has been applied and/or incorporated into a fibrous structure.

In another example, the fibrous structure may comprise two or more oil systems. For example, the fibrous structure may comprise a first oil system comprising a non-silicone oil according to the present invention and a second oil system comprising a silicone oil. The first oil system may be present within the fibrous structure at a greater weight percent than on a surface of the fibrous structure. In other words, the first oil system may migrate into the interior of the fibrous structure rather than being retained primarily on a surface of the fibrous structure. The second oil system may be retained more on a surface of the fibrous structure rather than migrating into the interior of the fibrous structure. Even though the first and second oil systems may be substantially discrete systems, not homogeneously mixed, the oil systems may interface with one another in light of the proximity to one another on and/or within the fibrous structure.

In even another example, the fibrous structures of the present invention may comprise a non-silicone oil comprising a triglyceride having a fatty acid profile containing a palmitic acid content of greater than about 15 wt % to about 100% and/or from about 20% to about 95% and a silicone oil, wherein a surface of the fibrous structure comprises a greater weight percent of the silicone oil than the non-silicone oil.

Nonlimiting examples of suitable silicone oils include aminosilicones.

In one example, the fibrous structure comprises an oil system according to the present invention, wherein the oil system comprises an oil that is in a liquid form in the fibrous structure. In another example, the fibrous structure comprises an oil system according to the present invention, wherein the oil system comprises an oil that is in a liquid form on a surface of the fibrous structure. In yet another example, the fibrous structure comprises an oil system according to the present invention, wherein the oil system comprises an oil that is in a liquid form in and on the fibrous structure.

Processes For Making Fibrous Structures

The fibrous structures of the present invention may be made by any suitable process known in the art. A nonlimiting example of a suitable process comprises the step of contacting a fibrous structure with an oil system comprising a non-silicone oil. In another example of a suitable process comprises the step of contacting a fibrous structure with an oil system comprising a non-silicone oil comprising a triglyceride having a fatty acid profile containing a palmitic acid content of greater than about 15 wt %.

The non-silicone oil may contact the fibrous structure such that the non-silicone oil uniformly distributes throughout the fibrous structure.

In one example, the non-silicone oil may contact the fibrous structure such that the non-silicone oil migrates into the fibrous structure such that the non-silicone oil is present at a greater weight percent within the fibrous structure than on a surface of the fibrous structure.

The step of contacting the fibrous structure with an oil system may be done by any suitable process known in the art such as spraying, brushing, slot extrusion, rotogravure roll printing, dipping, and other suitable processes.

The step of contacting may occur during papermaking, prior to drying of the fibrous structure and/or after drying of the fibrous structure and/or during converting of the fibrous structure, such as into a sanitary tissue product.

In one example, the oil system comprises an oil that is liquid under ambient conditions at least at the time of contacting the fibrous structure.

EXAMPLE 1

The following Example illustrates preparation of tissue paper according to the present invention. A pilot-scale Fourdrinier papermaking machine is used for the production of the tissue.

An aqueous slurry of NSK of about 3% consistency is made up using a conventional repulper and is passed through a stock pipe toward the headbox of the Fourdrinier.

In order to impart temporary wet strength to the finished product, a 1% dispersion of Parez 750® is prepared and is added to the NSK stock pipe at a rate sufficient to deliver 0.3% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 800 fpm (feet per minute) (about 198 meters per minute).

The embryonic wet web is transferred from the Fourdrinier wire, at a fiber consistency of about 15% at the point of transfer, to a patterned drying fabric made in accordance with U.S. Pat. No. 4,528,239, Trokhan, issued on 9 Jul. 1985. The speed of the patterned drying fabric is the same as the speed of the Fourdrinier wire. The drying fabric is designed to yield a pattern densified tissue with discontinuous low-density deflected areas arranged within a continuous network of high density areas. This drying fabric is formed by casting an impervious resin surface onto a fiber mesh supporting fabric. The supporting fabric is a 45×52 filament, dual layer mesh.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

The semi-dry web is then transferred to the Yankee dryer and adhered to the surface of the Yankee dryer with a sprayed creping adhesive. The creping adhesive is an aqueous solution with the actives in solution consisting of about 50% polyvinyl alcohol, about 35% CREPETROL A3025, and about 15% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The dry web is passed through a rubber-on-steel calendar nip.

After the calendar, an non-silicone oil system is spray applied to the web at the rate of 12% by weight. The non-silicone oil system consists of SansTrans25®, a palm olein fraction of palm oil marketed by Loders Croklaan of Channahon Ill. The spray applicator uses ITW Dynatec UFD nozzles, offered by Illinois Tool Works of Glenview, Ill. The UFD nozzles have five fluid orifices, each 0.46 mm×0.51 mm in size. The center of the 5 fluid orifices is oriented directly vertical to the path of the tissue paper web, while the outer orifices are angled at 15 degrees off of vertical, and the two intermediate nozzles are angled at 7.5 degrees relative to vertical. Each fluid orifice has an associated air orifice situated on either side of it, for a total of 10 air orifices, each of 0.51 mm×0.51 mm size. The fluid orifice extends 0.5 cm beyond the lower surface of the nozzle. Nozzles are spaced about 5 cm apart and about 5 cm above the tissue paper web while it is being treated. Air pressure sufficient to create a coarsely atomized spray is used.

After the non-silicone oil system is applied, the paper is wound in a roll using a surface driven reel drum having a surface speed of about 656 feet per minute.

The paper is subsequently converted into a two-ply toilet tissue having a basis weight of about 50 g/m$^2$, of which about 6 g/m$^2$ is SansTrans25®.

EXAMPLE 2

The following Example illustrates preparation of tissue paper according to one aspect of the present invention.

The same preparation as Example 1 is used for the preparation of Example 2 except for the following:

During the converting process, after the two-ply fibrous structure is formed, a surface softening agent is applied with a slot extrusion die to the outside surface of the product. The surface softening agent is a silicone dispersion (MR-1003®, marketed by Wacker Chemical Corporation of Adrian, Mich.). The 34% silicone solution is applied to the web at a rate of 0.5% by weight. The paper is subsequently wound into a two-ply toilet tissue having a basis weight of about 50 g/m$^2$, of which about 6 g/m$^2$ is bulk softening agent and about 0.25 g/m$^2$ is silicone surface softening agent.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising an oil system comprising a non-silicone oil wherein the non-silicone oil comprises a triglyceride having a fatty acid profile containing a palmitic acid content greater than about 15 wt %.

2. The fibrous structure according to claim 1 wherein the fatty acid profile further contains a myristic acid content of from greater than 0.5 to about 15 wt %.

3. The fibrous structure according to claim 2 wherein the fatty acid profile contains a myristic acid content of from about 1 to about 10 wt %.

4. The fibrous structure according to claim 3 wherein the fatty acid profile contains a myristic acid content of from about 1 to about 5 wt %.

5. The fibrous structure according to claim 1 wherein the non-silicone oil comprises a vegetable oil.

6. The fibrous structure according to claim 5 wherein the vegetable oil comprises palm oil.

7. The fibrous structure according to claim 5 wherein the vegetable oil is palm olein.

8. The fibrous structure according to claim 1 wherein the triglyceride exhibits a cis/trans ratio greater than about 8.

9. The fibrous structure according to claim 1 wherein the fatty acid profile further contains a linolenic acid content of less than about 2 wt %.

10. The fibrous structure according to claim 1 wherein the fibrous structure comprises natural fibers.

11. The fibrous structure according to claim 1 wherein the fibrous structure comprises synthetic fibers.

12. The fibrous structure according to claim 1 wherein the oil system comprises from about 90% to about 100% by volume of the oil system of the non-silicone oil and from 0 to less than 10% by volume of the oil system of a silicone oil, wherein the oil system is present at a greater level within the fibrous structure than on a surface of the fibrous structure.

13. The fibrous structure according to claim 12 wherein the oil system comprises from 0 to about 5% by volume of the oil system of the silicone oil.

14. The fibrous structure according to claim 12 wherein when the oil system comprises the silicone oil, the silicone oil and the non-silicone oil are in the form of a homogeneous mixture.

15. A single- or multi-ply sanitary tissue product comprising a fibrous structure according to claim 1.

16. A fibrous structure comprising a non-silicone oil comprising a triglyceride having a fatty acid profile containing a palmitic acid content of greater than about 15 wt % and a silicone oil, wherein a surface of the fibrous structure comprises a greater weight percent of the silicone oil than the non-silicone oil.

17. The fibrous structure according to claim 16 wherein the silicone oil comprises an aminosilicone.

18. A sanitary tissue product comprising a fibrous structure according to claim 16.

19. A process for making a fibrous structure, the process comprising the step of contacting a fibrous structure with an oil system comprising a non-silicone oil comprising a triglyceride having a fatty acid profile containing a palmitic acid content of greater than about 15 wt %.

20. The process according to claim 19 wherein the non-silicone oil comprises a vegetable oil.

21. The process according to claim 19 wherein upon contacting the fibrous structure, the non-silicone oil uniformly distributes throughout the fibrous structure.

22. The process according to claim 19 wherein the non-silicone oil contacts the fibrous structure such that the non-silicone oil migrates into the fibrous structure such that the non-silicone oil is present at a greater weight percent within the fibrous structure than on a surface of the fibrous structure.

* * * * *

UNITED STATES PATENT AND TRADEMARK OFFICE

CERTIFICATE OF CORRECTION

PATENT NO. : 7,582,577 B2
APPLICATION NO. : 11/387301
DATED : September 1, 2009
INVENTOR(S) : Kenneth Douglas Vinson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 832 days.

Signed and Sealed this

Fourteenth Day of September, 2010

David J. Kappos

David J. Kappos
*Director of the United States Patent and Trademark Office*